US012161905B2

(12) United States Patent
Tellam

(10) Patent No.: US 12,161,905 B2
(45) Date of Patent: Dec. 10, 2024

(54) WEIGHTLIFTING ACCESSORY

(71) Applicant: Custom Product Innovations, Inc., Lebanon, IL (US)

(72) Inventor: Dylan Tellam, Saint Louis, MO (US)

(73) Assignee: Custom Product Innovations, Inc., Lebanon, IL (US)

( * ) Notice: Subject to any disclaimer, the term of this patent is extended or adjusted under 35 U.S.C. 154(b) by 277 days.

(21) Appl. No.: 17/930,977

(22) Filed: Sep. 9, 2022

(65) Prior Publication Data

US 2024/0082619 A1 Mar. 14, 2024

(51) Int. Cl.
*A63B 21/072* (2006.01)
*A63B 21/08* (2006.01)
*A63B 23/035* (2006.01)

(52) U.S. Cl.
CPC ..... *A63B 21/0724* (2013.01); *A63B 21/08* (2013.01); *A63B 23/03508* (2013.01)

(58) Field of Classification Search
CPC ..... A63B 21/0724; A63B 21/0728; A63B 21/08; A63B 23/03508; A63B 71/0054; A63B 2071/0063
See application file for complete search history.

(56) References Cited

U.S. PATENT DOCUMENTS 605,747 A 6/1898 Sachs et al.
3,637,205 A * 1/1972 Bankston ..... A63B 21/012 84/477 B
3,690,655 A 9/1972 Chapman
3,942,790 A * 3/1976 Rice ..... A63B 21/012 482/131
5,071,279 A 12/1991 Rutstrom
5,207,624 A * 5/1993 Paskovich ..... A63B 21/072 482/109
5,971,891 A 10/1999 Humphrey
6,057,470 A 5/2000 Tsuneki et al.
8,888,666 B2 * 11/2014 Quader ..... A63B 21/0608 482/121
8,974,354 B1 * 3/2015 Nelson ..... A63B 21/08 482/94
9,289,646 B2 * 3/2016 Tully ..... A63B 23/03525
9,480,876 B1 * 11/2016 Blacklock ..... A63B 21/00072
(Continued)

OTHER PUBLICATIONS

Total Motion 360; TM 360 System; https://www.totalmotion360.com/; retrieved Aug. 23, 2022.

(Continued)

*Primary Examiner* — Joshua Lee
(74) *Attorney, Agent, or Firm* — Sheehan Phinney Bass & Green PA

(57) ABSTRACT

A weightlifting accessory includes a housing that defines a first (sleeve) portion and a second (rounded) portion. The first (sleeve) portion of the housing has one or more surfaces that define a cylindrical sleeve with a circular opening at an upper end thereof. The cylindrical sleeve and the circular opening are configured to receive a first end of a weightlifting bar (e.g., a barbell). The second portion of the housing defines a rounded exterior surface at a lower end of the first portion of the housing. In a typical implementation, coupling the weightlifting accessory to a barbell produces an assembly that is able to be used for exercises, for which the barbell alone would not be suitable.

22 Claims, 7 Drawing Sheets

(56) References Cited

U.S. PATENT DOCUMENTS

| | | | | |
|---|---|---|---|---|
| 9,616,269 | B1 * | 4/2017 | Burosh | A63B 21/0004 |
| 9,808,663 | B2 * | 11/2017 | Chen | A63B 21/4049 |
| 9,821,186 | B2 * | 11/2017 | Chen | A63B 23/1209 |
| 10,016,647 | B1 * | 7/2018 | Perez | A63B 65/06 |
| 10,029,134 | B2 * | 7/2018 | Gavigan | A63B 43/02 |
| 10,118,066 | B2 * | 11/2018 | Clerk | A63B 21/08 |
| 10,434,353 | B1 * | 10/2019 | Fabbri | A63B 21/00185 |
| 11,052,281 | B2 * | 7/2021 | Saldate | A63B 21/0442 |
| 11,148,000 | B2 * | 10/2021 | Sauers | A63B 15/00 |
| 11,278,760 | B1 * | 3/2022 | Hutchinson | A63B 21/4035 |
| 11,648,452 | B1 | 5/2023 | Zhang | |
| 2007/0184942 | A1 * | 8/2007 | Krietzman | A63B 21/072<br>482/110 |
| 2011/0251026 | A1 | 10/2011 | Stephan | |
| 2012/0149539 | A1 * | 6/2012 | Quader | A63B 21/0728<br>482/109 |
| 2018/0021662 | A1 * | 1/2018 | Carpinelli | A63B 21/0726<br>482/104 |
| 2018/0133539 | A1 * | 5/2018 | Hudson | A63B 21/0726 |
| 2020/0023230 | A1 * | 1/2020 | Saldate | A63B 23/1281 |
| 2021/0331028 | A1 * | 10/2021 | Saldate | A63B 21/072 |

OTHER PUBLICATIONS

Stronger Than U; The Gut Wrench, https://strongerthanu.com/products/the-gut-wrench; retrieved Aug. 23, 2022.

Sorinex Exercise Equipment; Landmine Rack Attachment; 1999; https://www.sorinex.com/products/landmine; retrieved Aug. 23, 2022.

* cited by examiner

WEIGHTLIFTING ACCESSORY

BACKGROUND

The weightlifting industry includes various accessories to serve different functions. Some accessories can be coupled to the end of a barbell to enable that barbell to be used for certain exercises that otherwise might not be possible or practical without the accessory. One example is the Landmine™ weightlifting attachment, available from the Sorinex® Exercise Equipment company. The Landmine™ weightlifting attachment, for example, has a sleeve that can be slid over the end of a barbell and a joint that allows the barbell to pivot about the joint.

SUMMARY OF THE INVENTION

In one aspect, a weightlifting accessory includes a housing that defines a first (sleeve) portion and a second (rounded) portion. The first (sleeve) portion of the housing has one or more surfaces that define a cylindrical sleeve with a circular opening at an upper end thereof. The cylindrical sleeve and the circular opening are configured to receive a first end of a weightlifting bar (e.g., a barbell). The second portion of the housing defines a rounded exterior surface at a lower end of the first portion of the housing. In a typical implementation, coupling the weightlifting accessory to a barbell produces an assembly that is able to be used for exercises, for which the barbell alone would not be suitable.

In another aspect, a method includes providing a weightlifting bar (e.g., a barbell) that has a first end and a second end opposite the first end and providing a weightlifting accessory that can be coupled to the weightlifting bar, for example, to produce an assembly that is able to be used for exercises, for which the weightlifting bar alone would not be suitable. The weightlifting accessory, for example, includes a housing that defines a first (sleeve) portion and a second (rounded) portion. The first (sleeve) portion of the housing has one or more surfaces that define a cylindrical sleeve with a circular opening at an upper end thereof. The cylindrical sleeve and the circular opening are configured to receive the first end of the weightlifting bar (e.g., with a compression fit between the two). The second (rounded) portion of the housing defines a rounded exterior surface at a lower end of the first portion of the housing. The method further includes sliding the first end of the weightlifting bar (e.g., a sleeve at one end of the barbell) through the opening on the weightlifting accessory and into the cylindrical sleeve. In some implementations, the method also includes sliding one or more weightlifting plates onto the second end of the weightlifting bar.

In a typical implementation, the weightlifting accessory (coupled to the weightlifting bar) is set upon a surface (e.g., the floor of a gym) and the assembly (of the optionally weighted weightlifting bar and the weightlifting accessory) is used by a human to perform exercises. The exercises, for example, may include repeatedly moving the second (optionally, weighted) end of the weightlifting bar between a first (e.g., lower) position and a second (e.g., higher) position while the weightlifting accessory maintains contact with the surface. In a typical implementation, the rounded exterior surface of the weightlifting accessory rolls, pivots, and/or swivels about a contact point on the surface, as the second end of the weightlifting bar moves between the first position and the second position. Moreover, at least the rounded exterior surface of the weightlifting accessory (and, in some instances, an entirety of the weightlifting accessory) is a slip resistant material (e.g., rubber and/or a rubber-like material), such that as the weightlifting accessory rolls, pivots, and/or swivels about the contact point on the surface, the accessory resists sliding across the surface.

The weightlifting bar can be virtually any kind of weightlifting bar. In one example, the weightlifting bar may be a barbell that includes a shaft, a collar at each end of the shaft, and a sleeve that extends from each collar to the first end or the second end of the weightlifting bar. In those instances, sliding the first end of the weightlifting bar through the opening and into the cylindrical sleeve of the weightlifting accessory includes sliding a first one of the sleeves of the weightlifting bar at the first end of the weightlifting bar through the opening and into the cylindrical sleeve of the weightlifting accessory. Moreover, sliding the one or more weightlifting plates onto the second end of the weightlifting bar includes sliding a second one of the sleeves of the weightlifting bar at the second end of the weightlifting bar through a hole in each of the one or more weightlifting plates.

In some implementations, the weightlifting accessory is configured such that each one of the cylindrical sleeve, the circular opening, and the rounded exterior surface of the weightlifting accessory is symmetrical about a common axis of the accessory. Moreover, in some implementations, the common axis of the weightlifting accessory aligns with an axis of the barbell when the barbell is coupled to the weightlifting accessory.

The second portion of the housing of the weightlifting accessory may define a passage (e.g., a pinhole) that extends through the second portion of the housing. In such instances, the passage enables air to be expelled from the cylindrical sleeve, through the passage as the first end of the weightlifting bar is slid through the opening and into the cylindrical sleeve. This may be important particularly where the sleeve achieves a compression fit over the end of the weightlifting bar. The passage typically has a smaller diameter than the cylindrical sleeve and the circular opening of the weightlifting accessory. Moreover, although this can vary, the passage typically lies along an axis that aligns with (e.g., is the same as) the common axis of the weightlifting accessory referred to above.

An entirety of the weightlifting accessory may be one material and may be manufactured, for example, in its entirety from a rubber or a rubber-like material (e.g., by molding the entirety of the accessory as a single, integrated component in a single molding process).

In some implementations, one or more of the following advantages are present.

First, in a typical implementation, coupling the weightlifting accessory disclosed herein to an end of a barbell for example produces an assembly that is able to be used for exercises, for which the barbell alone would not be suitable. In an exemplary implementation, the weightlifting accessory disclosed herein can slide securely onto the end of any standard barbell (e.g., with a 1.975" diameter sleeve) to facilitate a stationary nonfixed Landmine-type training experience, including exercises such as certain types of presses (see, e.g., FIGS. 8 and 9), rows, rotational work, push presses, push jerks, squats, split squats, lumberjack deadlifts, and more.

Moreover, in certain implementations, the accessory is a simply configured, single piece component (e.g., cast/molded, in its entirety, as one integrated component with no other pieces or parts beyond the integrated cast/molded component) that can be slid onto, and thereby convert, a traditional Olympic barbell, for example, into a piece of equipment suitable to facilitate a Landmine™-type training experience. In a typical implementation, one simply slides the accessory onto either end of the barbell and then work out anywhere, on any surface, without the need for mounting, bolting, or otherwise adhering the accessory to the surface.

In a typical implementation, the accessory is made of a soft, compressible material (e.g., a high-density polyurethane foam) and is soft enough so that its otherwise rounded exterior surface compresses against the floor under the weight of the barbell and as more weight is added to the barbell. This compression creates a larger surface area that is in contact with the floor which increases friction between the accessory and the floor. More weight on the bar equals more friction. Increased friction can be desirable because it decreases the chances of slippage. Also, in a typical implementation, the material that the accessory is made from (e.g., polyurethane foam) helps ensure a very good grip (e.g., between the accessory and the floor) and certain practices within the molding process can be implemented to increase that grip.

Additionally, in some implementations, the bulb shape of the weightlifting accessory, apart from the sleeve, is substantially spherical meaning that every point of the sphere apart from the sleeve can be rotated upon giving the weightlifting accessory a superior range of motion to any other potentially similar weightlifting accessories on the market. This is accomplished with no bearings or other mechanical components that may limit the direction of force, for example, that a user can apply in attempting various exercises. Thus, in a typical implementation, the weightlifting accessory disclosed here provides a user with a lifting experience that includes a large—virtually unlimited—number of planes in which force can be applied without hindrance. This makes implementations of the weightlifting accessory disclosed herein exceptional for rotational work where the traditional Landmine™ weightlifting attachment, for example, can be rather limited.

Moreover, in some implementations, the weightlifting accessory relies on a compression fit to connect to an end of a barbell. This allows it to operate without any cranks or fasteners needed to keep the device fixed to the barbell whether in use or not. This may be achieved by tension and friction. For example, where a traditional Olympic barbell sleeve generally has an outside diameter of 1.975" the sleeve of the weightlifting accessory may have an inside diameter of 1.935". Since the material used is relatively flexible it is capable of stretching around the sleeve of the barbell with relative ease and provide a strong grip. A small hole (e.g., a pin hole) is provided on the opposite end of the weightlifting accessory from the sleeve to allow air to escape when being installed to prevent any air pressure build up that would make the product difficult to install and to remove without any suction.

Additionally, in certain implementations, the weightlifting accessory disclosed herein can be attached to the lifting end of the barbell (i.e., the end opposite the one that remains close to the floor). In such implementations, the shape and material of the weightlifting accessory provides a highly comfortable grip for the opposite side of a barbell that is not in contact with the floor as a molded grip. Where most traditional methods of using a Landmine™ weightlifting attachment leave most users bearing a heavy load upon their palms, the weightlifting accessory disclosed herein offers a more ergonomic feeling with a better distribution of weight across the whole hand with a supple material compared to a rigid metal sleeve.

Other features and advantages will be apparent from the description and drawings, and from the claims.

BRIEF DESCRIPTION OF THE DRAWINGS

Like reference characters refer to like elements.

DETAILED DESCRIPTION

Figure 8:
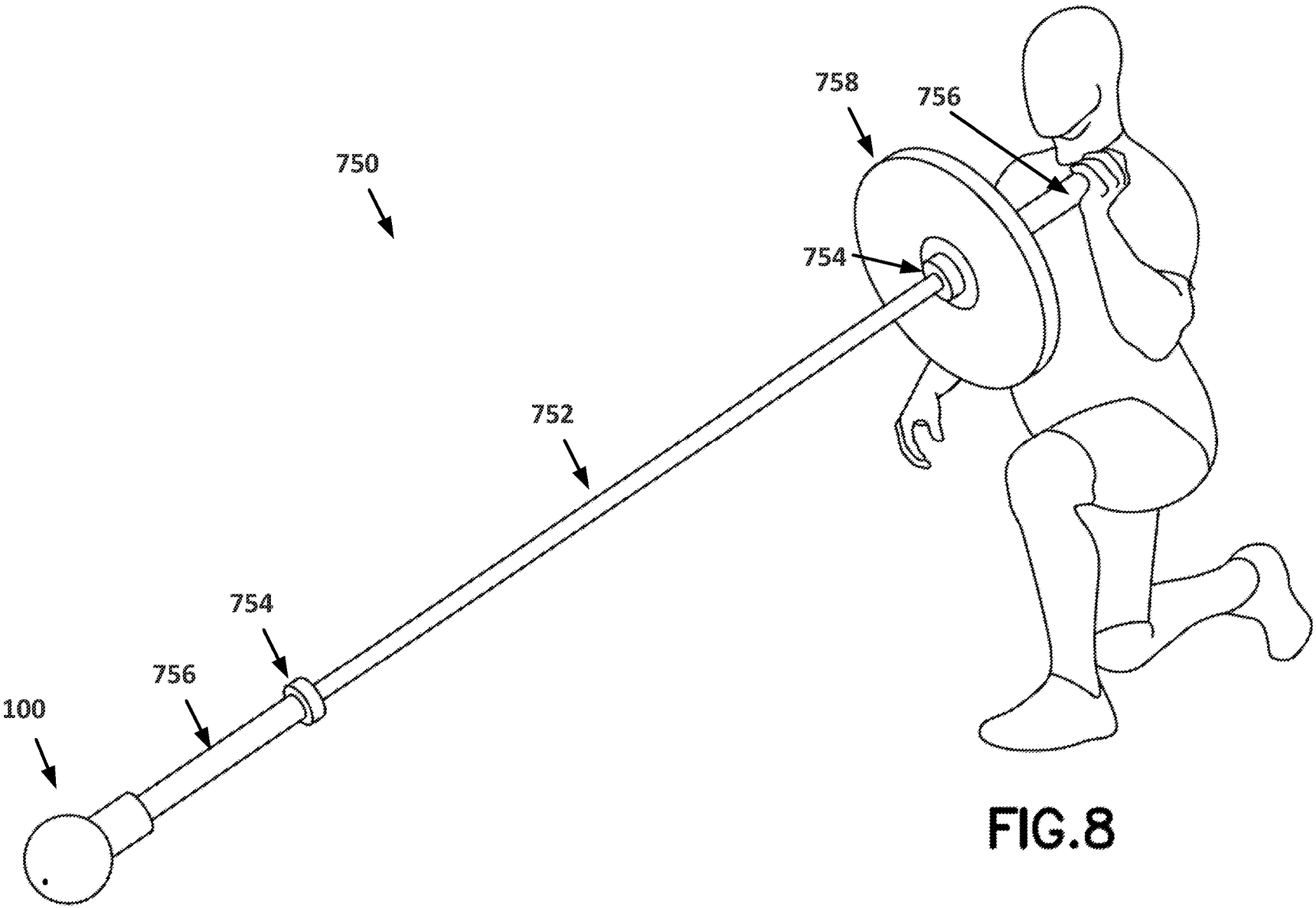
FIG. 8 and FIG. 9 show the weightlifting accessory of FIG. 1 coupled to the end of a barbell and being used by a human performing a single-arm shoulder press.
Figure 9:
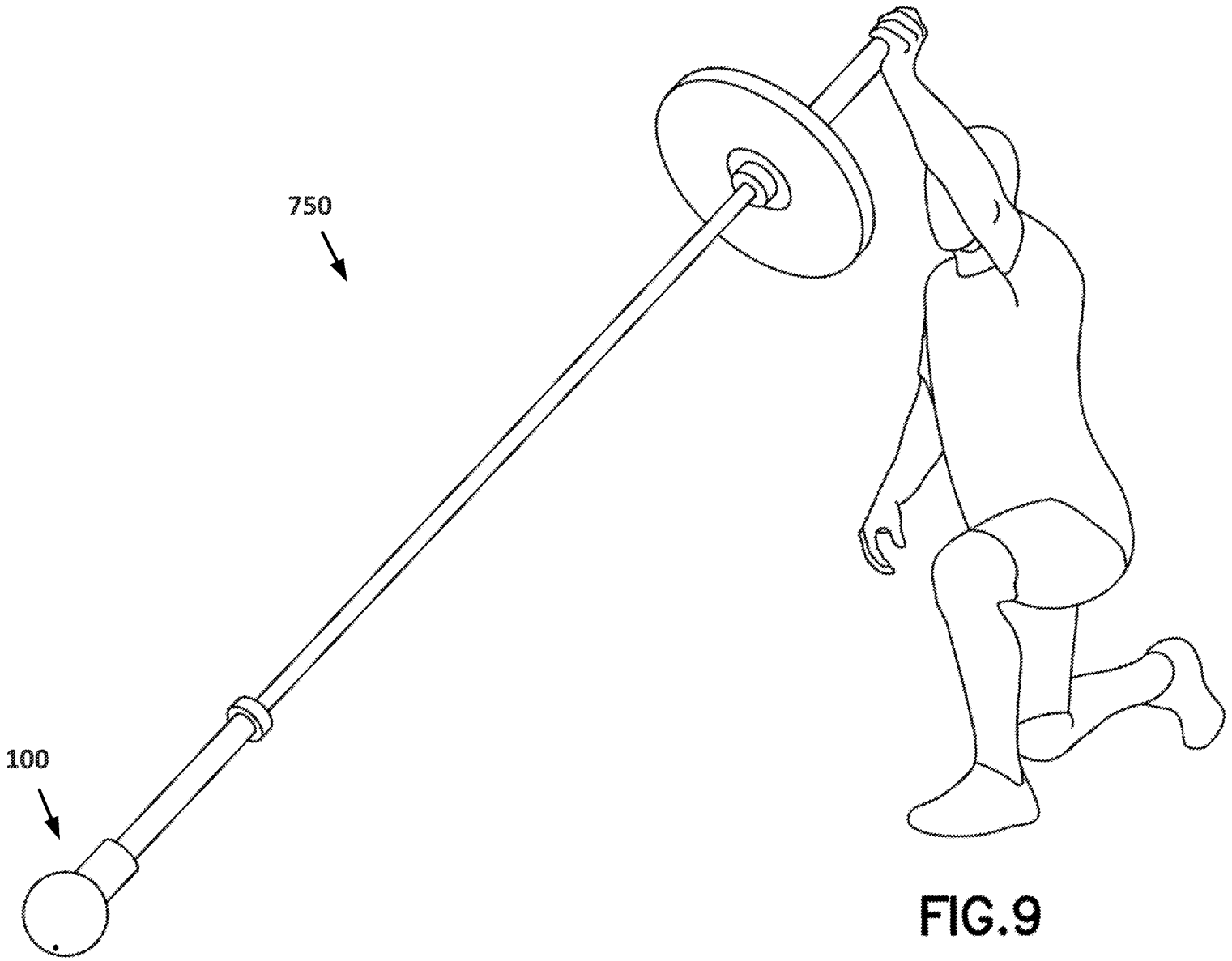

FIGS. 1-6 show an example of a weightlifting accessory 100 that can be attached, for example, to an end of a barbell to make the barbell suitable for use in performing various exercises that otherwise would be difficult or impossible to perform with only the barbell itself. These exercises can include, for example, certain types of presses (see, e.g., FIGS. 8 and 9), rows, rotational work, push presses, push jerks, squats, split squats, lumberjack deadlifts, and more. More specifically, with the weightlifting accessory 100 attached to one end of the barbell and with (optionally) one or more weightlifting plates added onto the opposite end of the barbell (as shown in FIGS. 8-9, for example), the weightlifting accessory 100 can be set down upon a surface (e.g., the floor of a gym) and a human weightlifter can lift and otherwise maneuver the other (weighted) end of the barbell to perform these exercises. As the weightlifter lifts and/or maneuvers the weighted end of the barbell, the weightlifting accessory 100 rolls, pivots, and/or swivels on the floor, while resisting slipping or sliding across the floor. In this regard, the weightlifting accessory 100 provides a great degree of freedom in the types of movement that the weightlifter can impart on the weighted end of the barbell, while maintaining constant contact with the floor and remaining substantially in place.

In a typical implementation, the weightlifting accessory 100 is light and compact, making it easy for the person to carry in his or her gym bag or the like. Moreover, it has a simple configuration and is relatively easy to manufacture. In most instances, in fact, the weightlifting accessory 100 is molded as a single, integrated component from rubber, or some other rubber-like material, or combination thereof, using a single step molding process. The material of the weightlifting accessory 100 (e.g., rubber) gives its slip-resistant characteristics.

The weightlifting accessory 100 has outer surfaces and inner surfaces. The major portions of the outer surfaces of the weightlifting accessory 100, seen for example in the view in FIG. 2, define a first (upper) portion 102 of the weighting accessory that has a cylindrical shape, and a second (lower) portion 104 that flares outward from the bottom of the cylindrical upper portion 102 and is rounded. The cylindrical upper portion 102 and the rounded lower portion 104 are both symmetrical relative to a longitudinal axis ("A") that passes through a longitudinal centerline of the weightlifting accessory 100. The maximum diameter $D_{LP}$ of the rounded lower portion 104 of the weightlifting accessory 100 is larger than the outer diameter $D_{UP}$ of the cylindrical upper portion 102 of the weightlifting accessory. The ratio between the two can vary. In various implementations, however, the maximum diameter $D_{LP}$ of the rounded lower portion 104 is between 50% and 100% larger than the outer diameter $D_{UP}$ of the cylindrical upper portion 102. In some implementations, the maximum diameter $D_{LP}$ of the rounded lower portion 104 is between 80% and 90% larger than the outer diameter $D_{UP}$ of the cylindrical upper portion 102. In one exemplary implementation, the maximum diameter $D_{LP}$ of the rounded lower portion 104 of the weightlifting accessory 100 is between 85% and 87% larger than the outer diameter $D_{UP}$ of the cylindrical upper portion 102 of the weightlifting accessory. In an exemplary implementation, the diameter $D_{LP}$ of the rounded lower portion 104 of the weightlifting accessory 100 is about 4.5 inches, but it could be anywhere from 2 inches to 10 inches.

In the illustrated implementation, a beveled surface 106 extends upward and inward from the upper edge of the cylindrical upper portion 102 of the weightlifting accessory 100 to a circular edge 108 at the top of the weightlifting accessory 100.

The overall height H of the weightlifting accessory can vary. In various implementations, the overall height H can be between 2 inches and 12 inches, or between 5 inches and 9 inches, or between 6 inches and 8 inches. In an exemplary implementation, the overall height H is about 7 inches. Moreover, height will vary depending on the sphere size and length of the sleeve. In various implementations, the height of the upper cylindrical portion 102 and beveled surface 106 of the weightlifting accessory 100 accounts for between 40% and 50% of the overall height H. In an exemplary implementation, the height of the upper cylindrical portion 102 and beveled surface 106 of the weightlifting accessory 100 accounts for about 43% to 45% of the overall height H.

Figure 6:
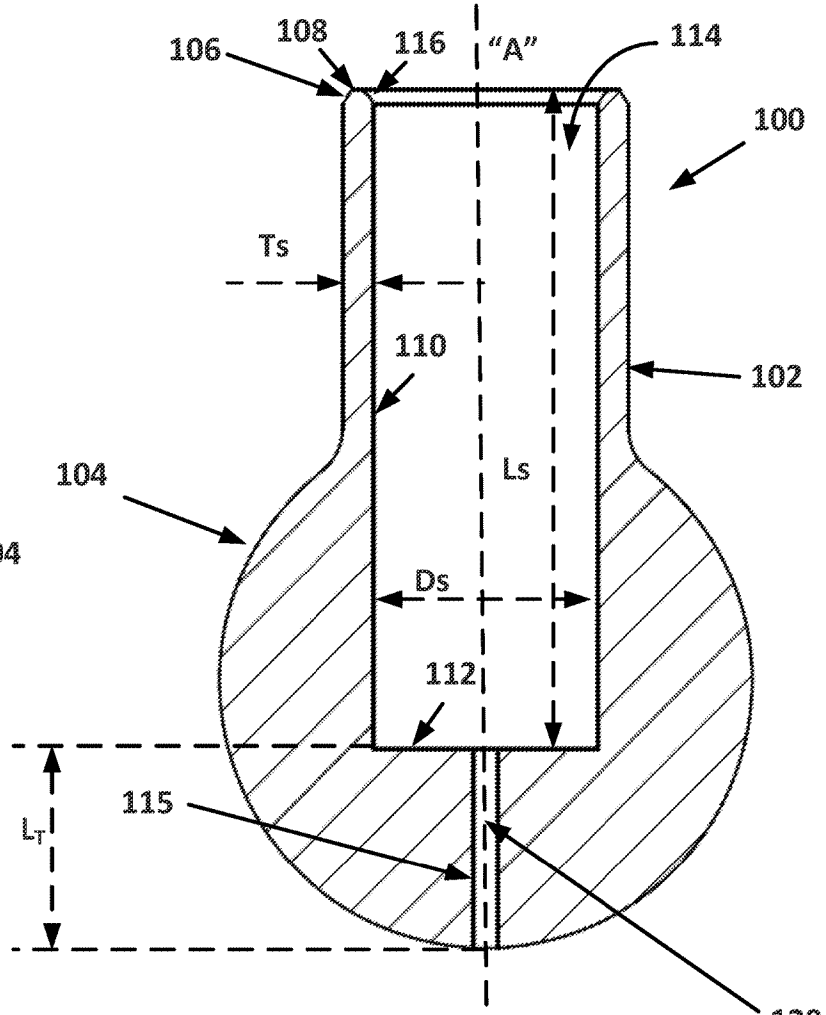
FIG. 6 is a cross-sectional side view of the weightlifting accessory of FIG. 1, taken along lines 6-6 in FIG. 2.
Figure 5:
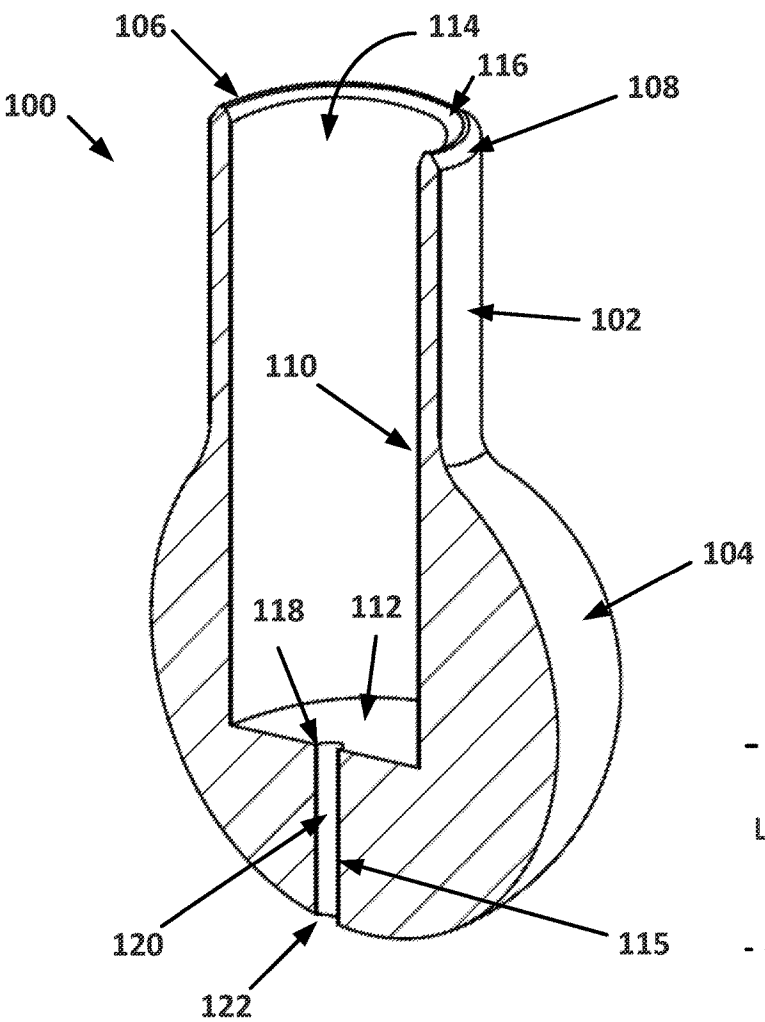
FIG. 5 is a cross-sectional perspective view of the weightlifting accessory of FIG. 1, taken along lines 5-5 in FIG. 1.

The major portions of the inner surfaces of the weightlifting accessory 100, best seen in FIGS. 5 and 6, include a first (upper) cylindrical surface 110, a flat surface 112 at the bottom of the upper cylindrical surface 110, and a second (lower) cylindrical surface 115 that extends from the flat surface 112 to the outer surface of the rounded portion of the exercise accessory 100. In the illustrated implementation, each of the upper cylindrical surface 110, flat surface 112, and lower cylindrical surface are symmetrical relative to the longitudinal axis ("A") of the exercise accessory 100.

The upper cylindrical surface 110 and the flat surface 112 at the bottom of the upper cylindrical surface 110 collectively define a cylindrical sleeve 114 in the exercise accessory 100 that is configured to receive an end of a weightlifting bar (e.g., barbell 750, see, e.g., FIGS. 7 through 10). In the illustrated implementation, a beveled surface 116 extends upward and outward from the upper edge of the cylindrical upper surface 102 inside the weightlifting accessory 100 to the circular edge 108 at the top of the weightlifting accessory 100.

The length (depth) $L_S$ of the cylindrical sleeve 114 (i.e., the distance between the top of the circular opening 108 and the flat bottom surface 110) can vary, for example, between 3.5 inches and 7.5 inches. In one exemplary implementation, the length $L_s$ is about 5.5 inches.

The inner diameter $D_S$ of the cylindrical sleeve 114 in the illustrated implementation is constant from the flat surface 112 up to the bottom of the bevel 116 near the top of the cylindrical sleeve 114. The inner diameter $D_S$ can vary, however, typically, the inner diameter $D_S$ is just large enough to receive and accommodate the portion of a barbell intended to be inserted into the cylindrical sleeve 114. Moreover, since the accessory 100 is typically made from a flexible material (e.g., rubber), this inner diameter $D_S$ may be slightly smaller than (but able to stretch over) the barbell it is intended to be used with. This inner diameter $D_S$ can vary, for example between 0.85 inches and 2.1 inches (e.g., depending on if the accessory were designed to fit a 1 inch barbell sleeve or a 2 inch barbell sleeve). In an exemplary implementation, the inner diameter $D_S$ is about 1.93 inches to 1.96 inches. In one very specific example, the inner diameter $D_S$ is 1.935 inches (e.g., for use with a barbell having a sleeve diameter of 1.975 inches).

In the illustrated implementation, the side wall of the cylindrical sleeve 114 in the upper cylindrical portion 102 of the weightlifting accessory 100 has unform thickness $T_S$ across its entirety. That thickness $T_s$ (i.e., the distance between the interior cylindrical surface 110 and the corresponding exterior cylindrical surface in a radial direction can vary, for example, between 1/16 of an inch and 1 inch. In one exemplary implementation, the thickness $T_s$ is between 1/8 of an inch and 3/16 of an inch.

The second (lower) cylindrical surface 115 defines an interior cylindrical tube 120 (or pinhole) that extends from a first hole 118 in flat surface 112 to a second hole 122 in the bottom of the outer surface of the rounded portion 104 of the exercise accessory 100. The tube 120 in the illustrated implementation extends along the longitudinal axis "A" of the exercise accessory 100. The tube 120 has a diameter $D_T$ (see, e.g., FIG. 3) that is significantly smaller than the diameter $D_S$ of the sleeve 114. In a typical implementation, the tube 120 provides an escape route for air being pushed out of the sleeve 114 when a tight-fitting end of a barbell is being pushed into the sleeve 114. The diameter $D_T$ of the tube 120 is generally less than 1/2 inch and in some instances may be 1/4 inch or smaller. The length $L_T$ of the tube 120 can vary as well. In general, the length $L_T$ of the tube 120 will depend on the overall length (or height H) of the exercise accessory 100 and the length $L_S$ of the sleeve 114. In essence, in a typical implementation, the length $L_T$ of the tube 120 can be defined by $H-L_S$. The length $L_T$ of the tube 120 can be between 1 inch and 3 inches. In an exemplary implementation, the length $L_T$ of the tube 120 is about 1 3/4 inches.

Figure 7:
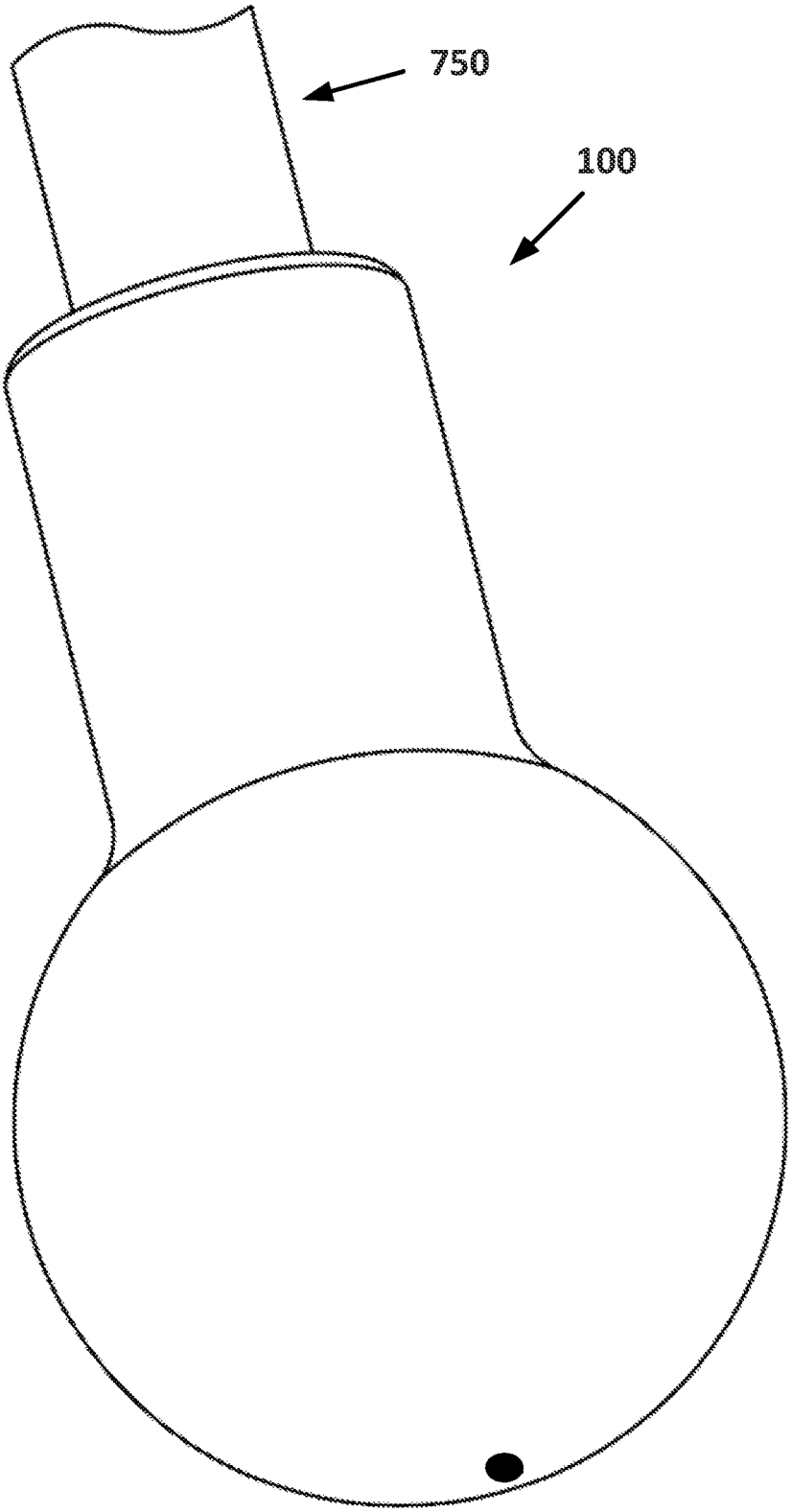
FIG. 7 is a perspective view of the weightlifting accessory of FIG. 1 attached to an end of a barbell.

FIG. 7 shows an end of a barbell 750 inserted into the cylindrical sleeve of an exemplary exercise accessory 100*a*. The weightlifting bar 750 and the cylindrical sleeve are configured relative to one another so as to provide a tight fit between the cylindrical sleeve of the weightlifting accessory 100 and the weightlifting bar 750 when the weightlifting bar is so inserted. In a typical implementation, this tight fit results in friction gripping between the weightlifting bar 750 and the cylindrical sleeve of the weightlifting accessory 100. This friction grip, when present, helps keep the weightlifting accessory 100 from inadvertently slipping off the end of the weightlifting bar 750 when the weightlifting bar 750 with the attached weightlifting accessory 100 is lifted off the ground for example. In such instances, even though there is a friction grip between the cylindrical sleeve of the weightlifting accessory 100 and the weightlifting bar 750, the friction grip typically can be overcome by applying a small but deliberate pulling force to separate the two components from one another.

Figure 10:
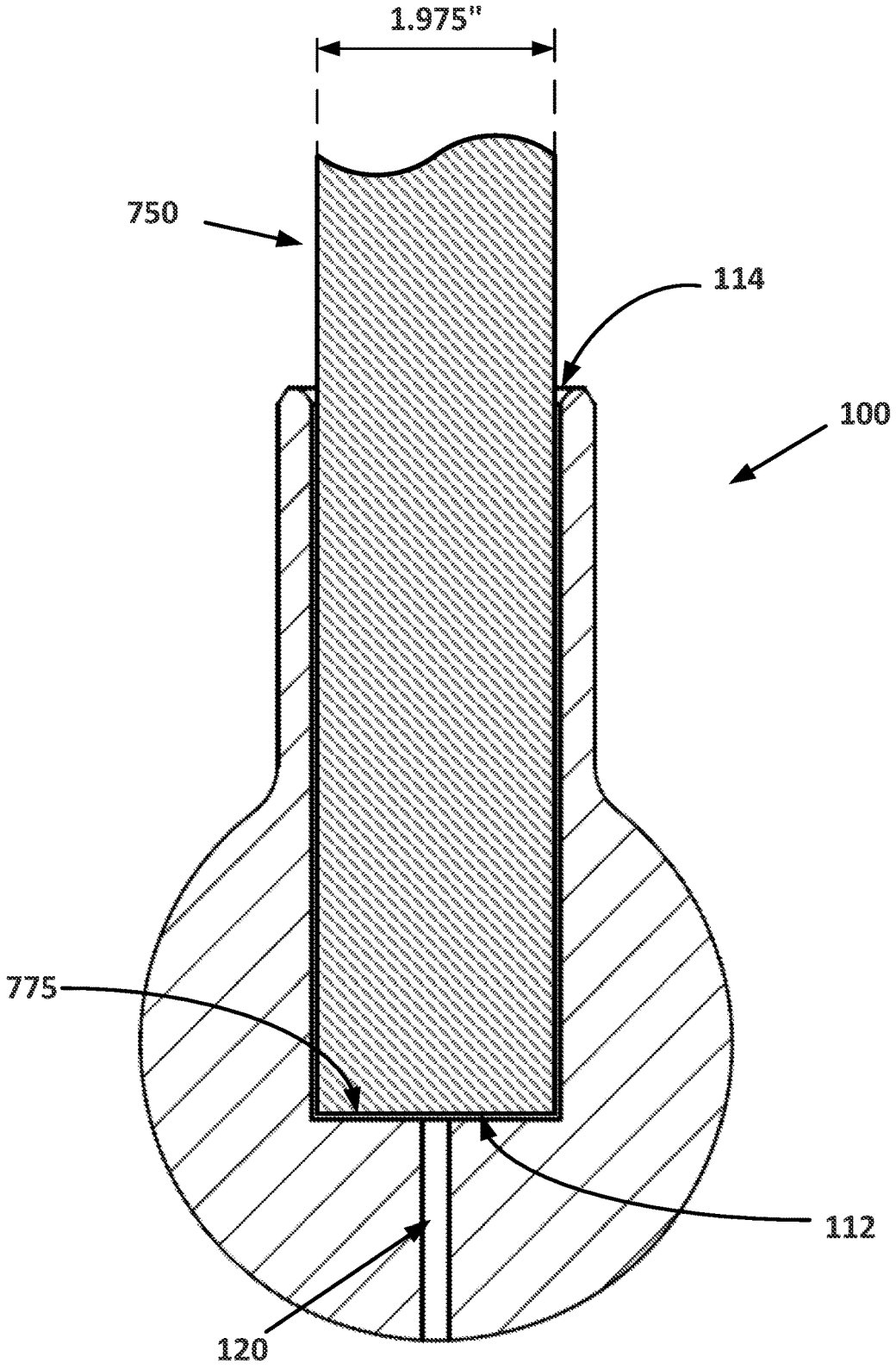
FIG. 10 is a cross-sectional side perspective view of the weightlifting accessory of FIG. 1 (like FIG. 6) coupled to the end of a barbell.

In a typical implementation, the end of the weightlifting bar 750 is inserted into the cylindrical sleeve of the exercise accessory 100 as far as possible, so that a distal end surface of the weightlifting bar (see, e.g., 775 in FIG. 10) ends up in direct physical contact with, and pressing against, the flat surface 112 at the bottom of the cylindrical sleeve 114. FIG. 10 further shows the tight fit between the cylindrical sleeve 114 and the end of the barbell 750.

FIGS. 8 and 9 show an example of the weightlifting accessory 100 attached to an end of a barbell 750 and being used by a human weightlifter 880 to perform an exercise. The configuration of the barbell 750, of course, can vary. However, in the illustrated implementation, the barbell 750 has a shaft 752, a collar 754 at each end of the shaft 752, and a sleeve 756 that extends from each collar to one of the ends of the barbell 750. The shaft 752 may have knurled portion(s) to facilitate gripping of the shaft by a weightlifter performing basic weightlifting exercises. Notably, the sleeves 756 at the ends of the barbell 750 where the lifter is actually gripping do not typically have knurling because these areas of the barbell are typically not held or gripped when a lifter is performing common exercises with a barbell. These common types of barbell exercises, include the flat bench press, the angled bench press, the shoulder press, the bent over row, the squat, the deadlift, etc. Each of these common exercises would involve gripping the shaft 752 of the barbell 750, not one of its sleeves 756.

A weight plate 758 is slipped onto an end of the barbell 750 opposite the weightlifting accessory 100 in FIGS. 8 and 9. The weightlifter in FIGS. 8 and 9 is moving this (weighted) end of the barbell 750 between a lowered position (in FIG. 8) and raised position (in FIG. 9) to perform a single arm shoulder raise. This is but one of many examples of exercises that can be performed using a barbell (weighted or not) with the weightlifting accessory 100 attached as shown to the barbell. These exercises include, for example, rows, rotational work, push presses, push jerks, squats, split squats, lumberjack deadlifts, and more.

Figure 2:
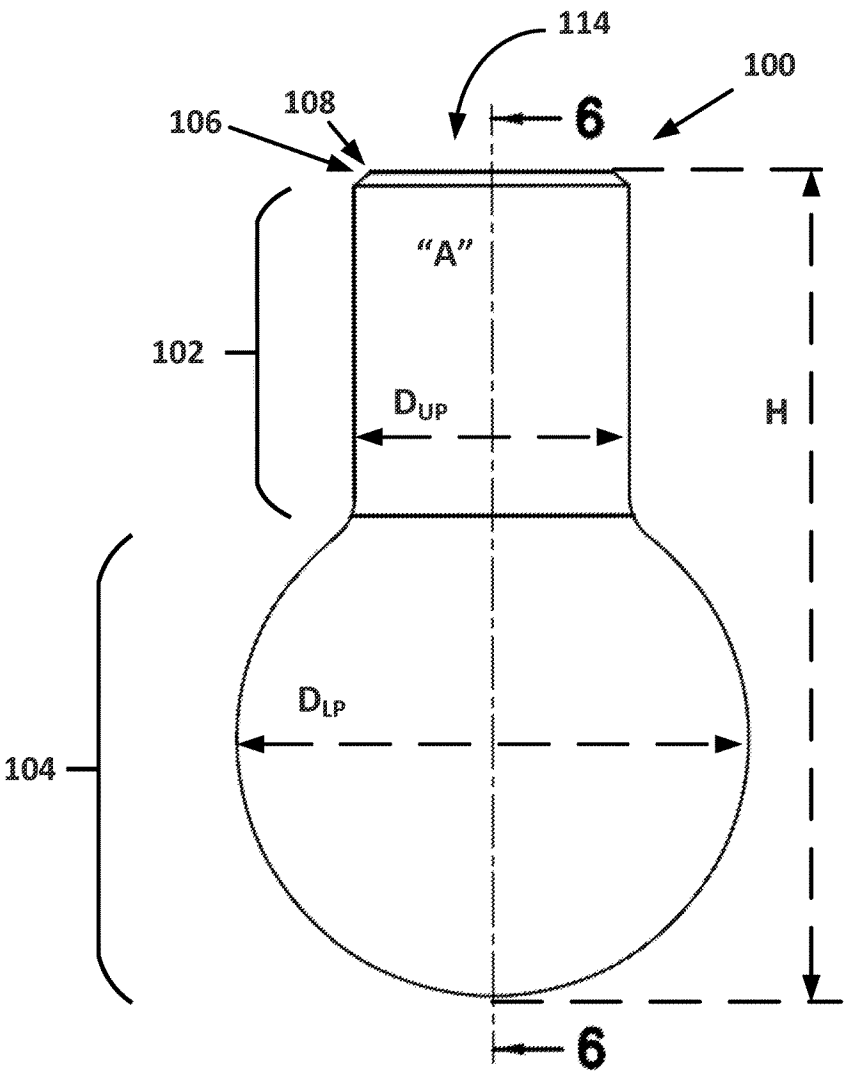
FIG. 2 is a side view of the weightlifting accessory of FIG. 1.
Figure 1:
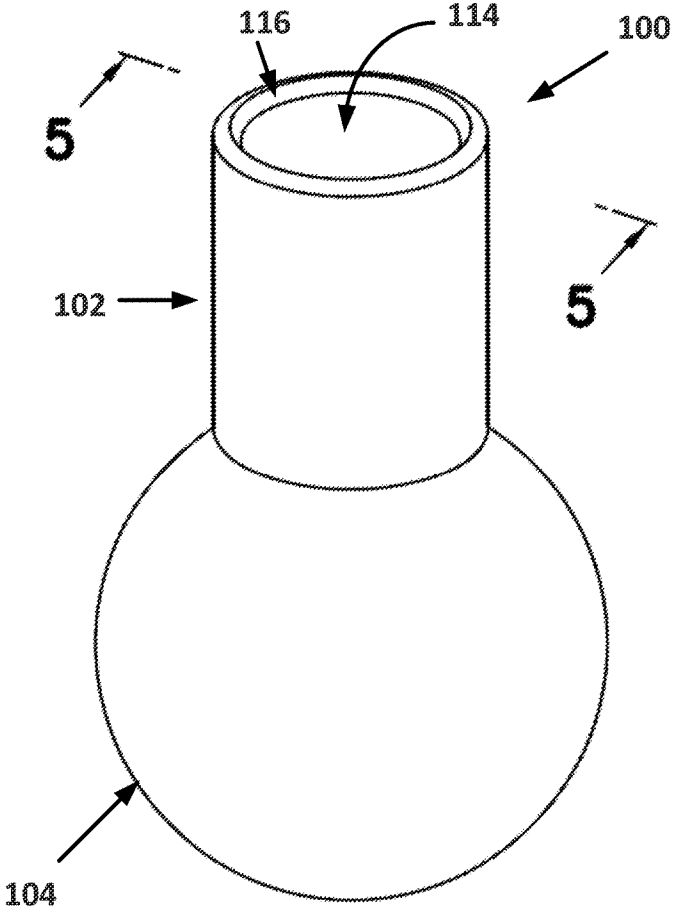
FIG. 1 is a perspective view of an implementation of a weightlifting accessory.
Figure 4:
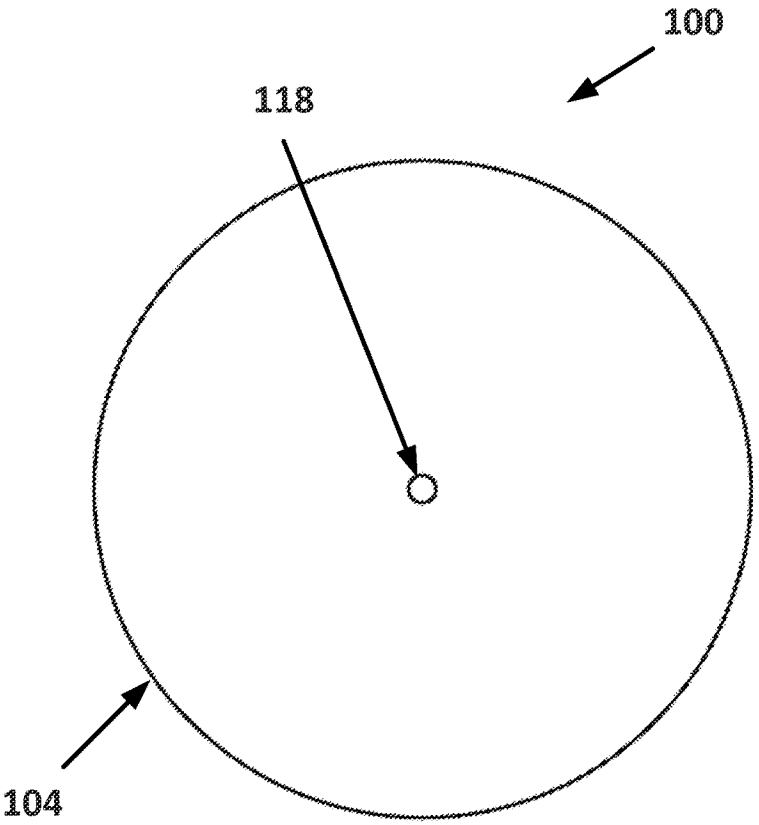
FIG. 4 is a bottom view of the weightlifting accessory of FIG. 1.
Figure 3:
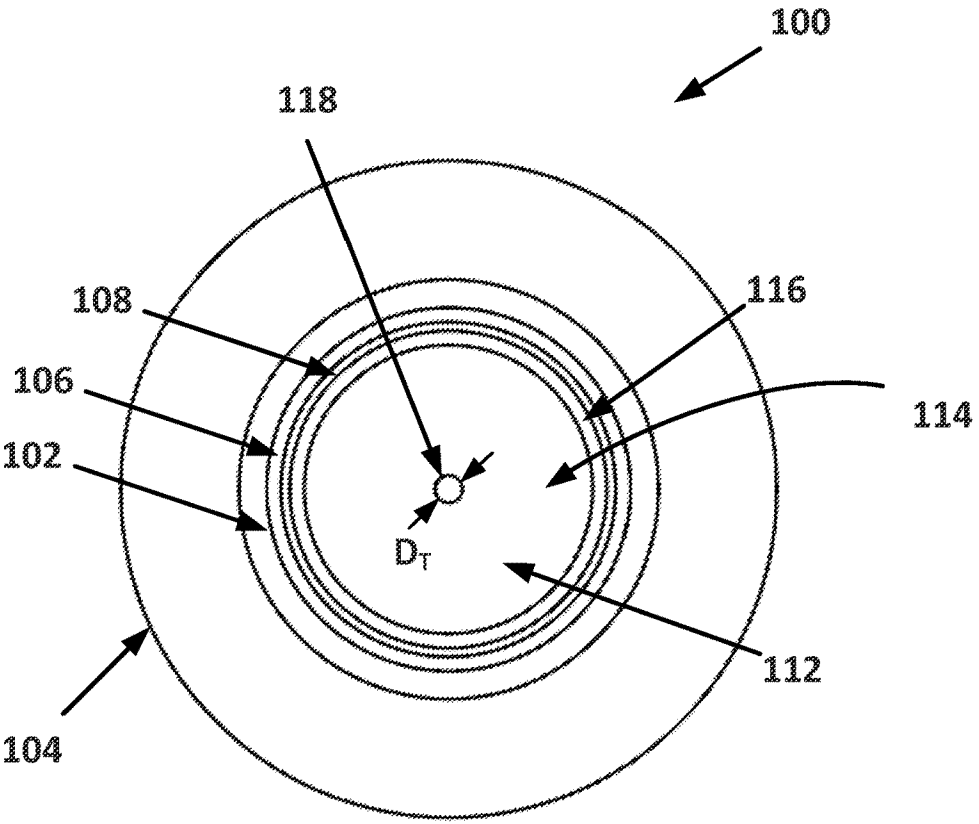
FIG. 3 is a top view of the weightlifting accessory of FIG. 1.

The weightlifting accessory 100 can be made from a variety of different types of materials. In a typical implementation, an entirety of the weighting accessory 100 is formed as a single, integrated component (e.g., by molding or casting the weightlifting accessory in one single molding or casting process). In such implementations, all of what is shown in FIG. 1 as item 100, for example, is a single piece that has been molded or cast using one and only one molding or casting process. The entirety of what is shown in FIG. 1 as item 100 is made of the same material and no portion or portions thereof can be removed from the item 100 without breaking the item 100. In a typical implementation, the entirety of the weightlifting accessory 100 is molded or cast from a rubber or rubber-like material (e.g., ethylene-vinyl acetate (EVA) and/or other materials having softness and/or flexibility about the same as a rubber) or materials that contain rubber or rubber-like materials. Typically, the material used to form the weightlifting accessory 100 is lightweight, durable, and elastic. Moreover, the material typically is slip resistant, such that the weightlifting accessory is able to roll, pivot, or swivel about a contact point on a surface, while resisting sliding across the surface. Typically, the entirety of the weightlifting accessory 100 is slip resistant, but at least the outer surface of the rounded portion of the weightlifting accessory should be slip resistant (like rubber).

In some instances, the weightlifting accessory 100 may be attached to the gripping end of the barbell 750 opposite the end where the weightlifting accessory is shown in FIGS. 8 and 9. In those instances, the weightlifting accessory 100 provides a comfortable grip for the weightlifter when performing exercises, such as the one represented in FIGS. 8 and 9. In those instances, a weightlifting accessory 100 may be attached to both ends of the barbell.

A number of embodiments of the invention have been described. Nevertheless, it will be understood that various modifications may be made without departing from the spirit and scope of the invention.

For example, the weightlifting accessory 100 can be configured to be used with any size or shape of barbell 200. The dimensions of the barbell 200 and its various sections, both absolute and relative, can vary. For example, the overall length of the barbell 200 can be anywhere from 5 feet to 8 feet or longer. A common overall length is 7 feet. A 7 foot bar typically has about a shaft length (i.e., the length between the collars 204) that is about 52 inches, so that the barbell 200 will be able to fit on a 48 inch wide squat rack (or bench press rack) with the collars and sleeves sitting just outside both sides of the rack. Some 6 foot bars may be made to the same dimensions but with the sleeved ends cut short, so they fit in a 48 inch wide rack. Some barbells, however, will not fit in such a rack. The sleeve length on a 7 foot barbell may be about 16 inches. If the barbell is shorter than 7 feet, then it typically has shorter sleeves, but this too can vary. The diameter (thickness) of the shaft 202 can range, for example, from 0.98 inches to 1.26 inches. The sleeved ends of an Olympic bar are, for example, just under 2" thick (e.g., approximately 1.975 inches). This too can vary as well+/−10% or more. In one implementation, the barbell 202 may have the following dimensions: overall length: 86.6 inches, shaft length: 51.6 inches, shaft diameter: 1.1 inches, sleeve diameter: 1.97 (or 1.975) inches. Moreover, in a typical implementation, the cylindrical sleeve 106 is sized to fit snugly around (and engage) the collar sleeve 206 of a standard Olympic-style barbell.

The upper portion of the cylindrical sleeve can be beveled (as discussed above), rounded, flat, etc. The smaller tube 120 in the weightlifting accessory (that can allow air to escape from the sleeve portion of the weightlifting accessory) can be tubular, as disclosed herein, or have any other cross-sectional shape (e.g., square, rectangular, triangular, etc.).

The specific configuration, as well as dimensions, absolute and/or relative, of the weightlifting accessory 100 and/or any one or more of its components may vary dimensionally (e.g., +/−5% or more) from what is explicitly disclosed herein. The portion of the sleeve that extends above the rounded lower portion 102 of the weightlifting accessory 100 is not necessary in all implementations, but it can help with stability and adhesion between the weightlifting accessory 100 and a barbell. When present, the portion of the sleeve that extends above the rounded lower portion 102 of the weightlifting accessory 100 may extend about 3 inches from where the sphere ends, making the entire device roughly 7 inches tall. In various implementations, the portion of the sleeve that extends above the rounded lower portion 102 of the weightlifting accessory 100 can be anywhere from 0 inches to 7 inches in length.

The depth of the sleeve, whether it extends above or is contained within the sphere portion of the accessory, can be important to the overall function of the accessory. The depth generally exceeds 50% of the diameter of the sphere. This helps facilitate rotation without any additional lift being created by the height of the sphere. For instance, an accessory with a 4.5 inch sphere generally has an internal sleeve depth of at least 2.25 inches or the device may not pivot optimally. Optimization aside the sleeve can simply rest atop a sphere without plunging past its center and still function but not with the ideal results.

In an exemplary implementation, the weightlifting accessory is formed, in its entirety, from a high density molded polyurethane foam molded out of an aluminum casting. The material choice is not limited to this selection or means of molding. Many different materials could be used including alternate foams such as Ethylene-vinyl acetate (EVA), urethane rubber, crumb rubber and other rubbers and rubber-like materials such as silicone and soft plastics. Additionally, more common materials such as wood and metal could be used on the right surfaces or all surfaces if any of those materials were dipped or coated or over molded (e.g., with high density molded polyurethane foam, rubber, or another more grippy material) as a secondary process. Additionally with regards to the molding process, other materials and substrates can be used to cast the product such as wood, plastic, resin, brass, steel, and/or similar rigid materials.

Although the weightlifting accessory may be formed in its entirety from a single type of material (e.g., in a single molding process) such that the material of the weightlifting accessory is the same throughout, in some instances, different portions of the weightlifting accessory may be made of different materials from one another. In those instances, typically, at least the rounded exterior surface of the accessory is a slip resistant material (e.g., rubber or rubber-like material), such that as the accessory is able to roll, pivot, or swivel about a contact point on the surface, while resisting slipping or sliding across the surface Some dimensions are described herein as being "about" or "approximately" some value. Unless otherwise indicated, these terms should indicate an acceptable degree of variation to accommodate standard manufacturing tolerances and/or +/−1% from the indicated dimension.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Other implementations are within the scope of the claims.

What is claimed is:

1. A method comprising:

providing a weightlifting bar that has a first end and a second end opposite the first end;

providing a weightlifting accessory comprising:

a housing that defines a first portion and a second portion, wherein the first portion of the housing has one or more surfaces that define a cylindrical sleeve with a circular opening at an upper end thereof, wherein the cylindrical sleeve and the circular opening are configured to receive the first end of the weightlifting bar, wherein the second portion of the housing defines a rounded exterior surface at a lower end of the first portion of the housing, and wherein the second portion of the housing of the weightlifting accessory defines a passage that extends through the second portion of the housing;

sliding the first end of the weightlifting bar through the opening and into the cylindrical sleeve; and enabling expulsion of air from the cylindrical sleeve through the passage as the first end of the weightlifting bar is slid through the opening and into the cylindrical sleeve.

2. The method of claim 1, further comprising:

sliding one or more weightlifting plates onto the second end of the weightlifting bar.

3. The method of claim 2, further comprising:

setting the weightlifting accessory on a surface; and performing an exercise by repeatedly moving the second end of the weightlifting bar between a first position and a second position while the weightlifting accessory maintains contact with the surface.

4. The method of claim 3, wherein the rounded exterior surface of the weightlifting accessory rolls, pivots, and/or swivels about a contact point on the surface, as the second end of the weightlifting bar moves between the first position and the second position.

5. The method of claim 4, wherein at least the rounded exterior surface of the weightlifting accessory is a slip resistant material, such that as the weightlifting accessory rolls, pivots, and/or swivels about the contact point on the surface, the weightlifting accessory resists sliding across the surface.

6. The method of claim 5, wherein an entirety of the weightlifting accessory is a rubber or a rubber-like material.

7. The method of claim 3, wherein the first position is lower than the second position relative to the surface.

8. The method of claim 2, wherein the weightlifting bar is a barbell that comprises:

a shaft;

a collar at each end of the shaft; and a sleeve that extends from each collar to the first end or the second end of the weightlifting bar, wherein sliding the first end of the weightlifting bar through the opening and into the cylindrical sleeve of the weightlifting accessory comprises:

sliding a first one of the sleeves of the weightlifting bar at the first end of the weightlifting bar through the opening and into the cylindrical sleeve of the weightlifting accessory, and wherein sliding the one or more weightlifting plates onto the second end of the weightlifting bar comprises:

sliding a second one of the sleeves of the weightlifting bar at the second end of the weightlifting bar through a hole in each of the one or more weightlifting plates.

9. The method of claim 1, wherein the weightlifting accessory is configured such that each one of the cylindrical sleeve, the circular opening, and the rounded exterior surface of the weightlifting accessory is symmetrical about a common axis of the weightlifting accessory.

10. The method of claim 9, wherein the weightlifting accessory is configured such that the common axis of the weightlifting accessory aligns with an axis of a barbell when the barbell is coupled to the weightlifting accessory.

11. The method of claim 1, wherein the passage has a smaller diameter than the cylindrical sleeve and the circular opening of the weightlifting accessory.

12. The method of claim 11, wherein an axis of the passage aligns with a common axis of the weightlifting accessory.

13. The method of claim 1, further comprising:

manufacturing an entirety of the weightlifting accessory from a rubber or a rubber-like material by molding the entirety of the weightlifting accessory as a single, integrated component in a single molding process.

14. A weightlifting accessory comprising:

a housing that defines a first portion and a second portion, wherein the first portion of the housing has one or more surfaces that define a cylindrical sleeve with a circular opening at an upper end thereof, wherein the cylindrical sleeve and the circular opening are configured to receive a first end of a weightlifting bar, wherein the second portion of the housing defines a rounded exterior surface at a lower end of the first portion of the housing, and wherein the second portion of the housing has surfaces that define a passage that extends in a radial direction from the cylindrical sleeve, through the second portion of the housing, wherein the passage has a smaller diameter than the cylindrical sleeve and the circular opening.

15. The weightlifting accessory of claim 14, wherein an exterior cylindrical surface of the first portion of the housing has a first diameter, wherein the rounded exterior surface of the second portion of the housing has a second diameter, and wherein the second diameter is larger than the first diameter by a ratio of at least 1.6 to 1.

16. The weightlifting accessory of claim 14, wherein at least the rounded exterior surface of the second portion of the housing is a slip resistant material, such that the weightlifting accessory is able to roll, pivot, or swivel about a contact point on a surface, while resisting slipping along the surface.

17. The weightlifting accessory of claim 16, wherein each one of the cylindrical sleeve, the circular opening, and the rounded exterior surface is symmetrical about a common axis.

18. The weightlifting accessory of claim 17, wherein an axis of the passage aligns with the common axis.

19. The weightlifting accessory of claim 14, wherein an entirety of the weightlifting accessory is a rubber or a rubber-like material.

20. An assembly comprising:

a weightlifting accessory comprising:

a housing that defines a first portion and a second portion, wherein the first portion of the housing has one or more surfaces that define a cylindrical sleeve with a circular opening at an upper end thereof, wherein the cylindrical sleeve and the circular opening are configured to receive a first end of a weightlifting bar, wherein the second portion of the housing defines a rounded exterior surface at a lower end of the first portion of the housing, wherein an exterior cylindrical surface of the first portion of the housing has a first diameter, wherein the rounded exterior surface of the second portion of the housing has a second diameter, and wherein the second diameter is larger than the first diameter by a ratio of at least 1.6 to 1, wherein the second portion of the housing has surfaces that define a passage that extends in a radial direction from the cylindrical sleeve, through the second portion of the housing, wherein the passage has a smaller diameter than the cylindrical sleeve and the circular opening, wherein each one of the cylindrical sleeve, the circular opening, the rounded exterior surface, and the surfaces that define the passage is symmetrical about a common axis, wherein the housing has an overall height between 5 inches and 9 inches, wherein the cylindrical sleeve has an inner diameter between 0.85 inches and 2.1 inches and a length between 3.5 inches and 7.5 inches, and wherein an entirety of the weightlifting accessory is a rubber or a rubber-like material.

21. The assembly of claim 20, further comprising:

a weightlifting barbell comprising:

a shaft;

a collar at each end of the shaft; and a sleeve that extends from each collar to the first end or the second end of the weightlifting barbell, wherein a first one of the sleeves of the weightlifting barbell at the first end of the weightlifting barbell is configured to slide through the opening and into the cylindrical sleeve of the weightlifting accessory and to grip, with a compression fit, the first one of the sleeves.

22. The assembly of claim 21, further comprising:

one or more weightlifting plates configured to slide onto a second one of the sleeves of the weightlifting barbell at the second end of the weightlifting barbell through a hole in each of the one or more weightlifting plates.

* * * * *